US005885103A

United States Patent [19]

Ernolf et al.

[11] Patent Number: 5,885,103

[45] Date of Patent: Mar. 23, 1999

[54] ELECTRICAL CONNECTION DEVICE

[75] Inventors: Stig Carl-Oskar Ernolf, Sollentuna; Lars Henrik Lindqvist; Bo Uno Egon Henningsson, both of Nynäshamn, all of Sweden

[73] Assignee: Telefonaktiebolaget LM Ericsson, Stockholm, Sweden

[21] Appl. No.: 750,257

[22] PCT Filed: Jun. 2, 1995

[86] PCT No.: PCT/SE95/00639

§ 371 Date: Dec. 5, 1996

§ 102(e) Date: Dec. 5, 1996

[87] PCT Pub. No.: WO95/34923

PCT Pub. Date: Dec. 21, 1995

[30] Foreign Application Priority Data

Jun. 10, 1994 [SE] Sweden ..... 9402016

[51] Int. Cl.[6] ..... H01R 9/05

[52] U.S. Cl. ..... 439/579; 439/608; 439/246; 439/95

[58] Field of Search ..... 439/579, 620, 439/610, 607, 95, 608, 246

[56] References Cited

U.S. PATENT DOCUMENTS

| | | | |
|---|---|---|---|
| 3,670,292 | 6/1972 | Tracy . | |
| 4,020,430 | 4/1977 | Vander Heyden | 439/620 |
| 4,029,836 | 6/1977 | Krantz, Jr. et al. . | |
| 4,362,350 | 12/1982 | von Harz | 439/608 |
| 4,820,201 | 4/1989 | Van Brunt et al. . | |
| 5,174,770 | 12/1992 | Sasaki et al. | 439/607 |
| 5,192,216 | 3/1993 | Knauber et al. | 439/579 |
| 5,257,949 | 11/1993 | Paulus | 439/620 |
| 5,334,035 | 8/1994 | Wehrle et al. | 439/246 |
| 5,632,652 | 5/1997 | Zell et al. | 439/607 |

*Primary Examiner*—Neil Abrams
*Assistant Examiner*—Katrina Davis
*Attorney, Agent, or Firm*—Burns, Doane, Swecker & Mathis, L.L.P.

[57] ABSTRACT

The invention relates to a coaxial cable plug-in assembly for coaxial cables and including an electrical connection assembly. The electrical connection assembly can be connected to ground potential. The plug-in assembly includes two complementary parts. At least one of the plug-in assembly parts embraces an electrically insulating base member which is intended to accommodate a connecting device and which includes at least one through-penetrating hole adapted for coaction with a first subpart of a sleeve-like connecting device, and with a second subpart adapted for coaction with a coaxial cable whose screening conductor is intended to embrace the second subpart of the connecting device. The electrical connection assembly includes a spring-like collar which extends completely or partially around the second subpart of the connecting device for electrical and mechanical coaction between the subpart and the collar, and further includes a supportive part which coacts with the collar. The supportive part includes outer contact surfaces which are intended to abut the inner surface of a metal subpart with an adapted contact pressure, this inner surface being, in turn, related to ground potential.

7 Claims, 3 Drawing Sheets

ELECTRICAL CONNECTION DEVICE

TECHNICAL FIELD

The present invention is intended for application in an electric plug-in assembly, and then particularly, but not exclusively, in an electric plug-in assembly which includes electrical connection means adapted for coaction with a plurality of coaxial cables, and is even more concerned with a metallic electrical connection means which is included in the cable-related part of the plug-in assembly and which can be connected to an ground potential or ground reference.

It is fundamental to the invention that the electric plug-in assembly is comprised of two complementary parts wherein at least one metallic casing part or said one assembly part can be connected externally or internally to ground potential and wherein at least one of said assembly parts is divided into several parts, normally two parts.

The two complementary parts of the plug-in assembly are mutually coordinated so that they can be brought to a mutually coacting position for electrical and mechanical coaction between coaxial-cable adapted electrical connection means placed in respective assembly parts and carrying a base member which can be embraced by the casing parts, or to a non-coacting position in which there is no electrical and mechanical coaction between coaxial-cable adapted electrical connection means mounted in said complementary parts.

Electric plug-in assemblies of the kind to which the present invention refers thus comprise two complementary parts, and the invention finds particular application when one of said parts is a circuit-board associated part and the other part is a cable-related part, wherein each of said parts includes a metallic casing which is adapted to fully embrace an electrically insulating base member into which there is inserted a plurality of electrically conductive coaxial contact devices. The metallic casing for the cable-related part may advantageously comprise two parts.

In other respects, the parts of the plug-in assembly are constructed so that at least one of said parts will embrace a base member which is made of an electrically insulating material and intended for one connecting device. The base member includes through-penetrating holes or channels which are adapted to hold or to coact with a first subpart of a sleeve-like coaxial-cable adapted connecting device, wherein said first subpart is intended to coact with a first subpart of a complementary connecting device and with a second subpart which is adapted for coaction with a stripped end of the coaxial cable, said cable end being stripped so as to expose the central conductor of the cable and also to expose an embracing screening conductor or screening stocking.

This coaction is achieved, among other things, by virtue of turning the screening conductor around a support sleeve fitted over said second subpart, wherein the screening conductor is clamped firmly between the second subpart and the inner surface of an outer clamping sleeve provided with electrical connection means, while using the support sleeve.

The present invention can be applied to particular advantage in grounded circuit board magazines, in which an external conductor and/or conductors is/are caused to coact with circuit-board related circuit, conductors and the like via electric connecting devices.

Magazines of the type intended here are adapted to handle in electronic circuits information-carrying signals whose current and/or voltage pulses can have a frequency or bit rate that lies within the Gb/s range.

Electronic systems of the kind intended are encumbered with the drawbacks that high frequency electromagnetic signals "leak" out as radio waves and the circuits become sensitive to such electromagnetic disturbance fields and therewith lose their ability to transmit the information-carrying signals correctly.

The invention is therefore intended from certain aspects to provide a system in which all disturbing signal routes are carefully screened and related to ground potential.

The invention is also intended to overcome EMC-type disturbance fields (Electro Magnetic Compatibility).

DESCRIPTION OF THE BACKGROUND ART

Several different designs of electric plug-in assemblies in general and coaxial cable plug-in assemblies in particular are known to the art.

At the high, and even higher, transmission speeds aforementioned, and when using coordinated contacts or contact devices in an electric plug-in assembly intended for coaxial cables, it is important that signal transmission can take place from a first coaxial cable to circuit board components such that the central conductors of the coaxial cables or the like obtain good contact with one another through the medium of the connecting devices of the plug-in assembly, although it is also important that the screening conductor of the coaxial cable is intact and connected directly to ground upstream of the system earth on the circuit board, also through the medium of the plug-in assembly, so that electromagnetic disturbances will be passed to ground before manifesting as disturbances on the system ground.

In the case of coaxial cable plug-in assemblies, measures have already been taken to ensure that good electrical contact is achieved between the central conductors and that good screening is also achieved through the plug-in assembly.

It is also known that when the transmission speed of the digitalized signals or current pulses, or the so-called bit rate, increases up towards 150 Mb/s and higher, the plug-in assemblies used become sensitive to occurrent disturbance voltages and that the transmitted current pulses can become distorted to such an extent as to make it difficult or impossible to understand the pulses.

Large voltages that occur on screening conductors have a highly negative effect in this respect.

It has been found practical to take measures for connecting the screening conductor directly to ground potential at a point located some distance upstream of the circuit board.

It is also known (U.S. Pat. No. 4,820,201) to connect the screening conductor of a coaxial cable to a metallic plug-in-assembly casing with the aid of a metal plate.

It is also known (U.S. Pat. No. 3,670,292) to use a foil having inner and outer resilient tabs for grounding purposes.

SUMMARY OF THE INVENTION

Technical Problems

When considering the present standpoint of techniques as described above, it will be seen that a technical problem resides in providing in an electric plug-in assembly intended for a plurality of coaxial cables electrical connection means which can be connected to ground potential and which can be readily enclosed in the cable-related metal casing part of the assembly and be able to establish contact with all screening conductors and sleeves and also to coact with the inner metal surfaces of the casing parts, wherewith said casing parts can be connected externally directly to ground potential.

It will be seen that a further technical problem is one of giving the electrical connection means a form which will not only conform readily to the interior space of one cable-related casing part of the plug-in assembly but which will provide a saving in material at the same time.

It will also be seen that a technical problem resides in providing a electrical connection means whose form and structure are well suited for application as a separate material-lean unit within the casing part while still providing good electrical contact with each exposed subpart of the connecting devices so as to provide good electrical spring contact and a mechanically stable connection between each subpart and the metallic casing part or parts.

Another technical problem is one of realizing the significance of allowing the electrical connection means to embrace and coact with an outer surface of a sleeve which belongs to a coaxial contact device through the medium of resilient tabs or tongues, said sleeve being caused to clamp the screening conductor firmly around the sleeve-like subpart (second subpart) of the connecting device and/or adjacent said sleeve.

It will also be seen that a further technical problem is one of realizing the significance of and the prerequisites for providing the electrical connection means with four spring-related tabs or tongues which extend completely or partially around the second subpart of the connecting device and/or sleeve, so as to provide electric and mechanical coaction between a subpart and the sleeve with the aid of said tabs or tongues, and a supportive part which coacts with the tabs or tongues and integrated therewith.

It will also be seen that a technical problem is one of realizing the significance of distributing ground-potential related contact points of the electrical connection means uniformly around the earth-related screening conductor or stocking of the coaxial cable.

It will also be seen that a technical problem resides in realizing with regard to a desired ground connection those advantages that are afforded when said supportive part is provided with a small number of sparsely distributed outer contact surfaces and when the contact surfaces are adapted and dimensioned to abut the inner surfaces of opposing metal parts with a sufficient and adapted contact pressure, and to provide external means for connecting said parts to ground potential.

It will also be seen that a technical problem resides in providing a material-lean electrical connection means which is able to coact with each coaxial-cable related connecting device inserted into a base member, even when the number of holes in the base member exceeds the number of connecting devices to be accommodated by said holes.

It will also be seen that a technical problem resides in realizing the significance of allowing the spring-like tabs to be formed by four corner-related resilient projections which extend from said supportive part, such that the length and spring-properties of the tabs will permit said inner tongues and the second subpart of the connecting device and said supportive part to take mutually different positions, so as to create therewith conditions which will enable each sleeve-like connecting device inserted into a hole in the base member to adapt to good coaction with each corresponding and complementary connecting device.

Another technical problem resides in the significance of giving said supportive part a right-angled shape and to adapt its outer dimensions for enclosure in one of said metal parts.

It will also be seen that another technical problem resides in realizing the significance of providing the supportive part with requisite discrete contact surfaces, a number of outer surfaces which face towards the inner surfaces of the metal parts, and four and four facing towards an adjacent coupling device.

It then becomes a technical problem to realize the significance of providing the supportive part with first category contact surfaces, namely four and four corner-related surfaces for each connecting device and located outermost on contact springs that extend obliquely to one another.

A further technical problem is one of providing with simple means conditions whereby the requisite contact surfaces will be formed by the tips of four elongated, narrow resilient metal parts or tabs, with the tips extending obliquely but essentially towards one another.

It will also be seen that a technical problem resides in realizing the significance of locating said contact surfaces in a first plane which extends adjacent a resilient section having said narrow, elongated resilient parts.

It will also be seen that a further technical problem is one of realizing the significance of providing a construction in which a second category of contact surfaces are formed in a second plane which extends parallel with said first plane.

Another technical problem is one of realizing that electrical connection means of the aforesaid kind can use a base member which includes a plurality of mutually parallel holes or channels, with said holes or channels disposed in rows and columns, such as two rows and three columns.

It will also be seen that in this technical field and in the case of an electrical connection means of the kind defined in the introduction a further technical problem resides in realizing the significance of allowing one subpart of each connecting device to be mounted in its respective hole in the base member such that said subpart can be tilted or tipped therein, and to permit an assigned pivot axle or fulcrum point to be moved to or in the proximity of said electrical connection means.

It will also be seen that a technical problem resides in realizing the significance of giving the connecting-means supportive part a rectangular outer shape which is adapted to enable supportive parts having edge-orientated discrete, resilient parts to abut a metallic casing part.

It will also be seen that a technical problem resides in realizing the manufacturing/technical and use/technical advantages that are afforded when the outer resilient parts are comprised of parallel-related projections.

It will also be seen that a technical problem resides in providing electrical connection means of the kind defined in the introduction and intended for the aforesaid application which have a material thickness of between 0.07–0.25 mm, and therewith to realize the significance of choosing stainless steel as the material used.

A further technical problem is one of realizing that said electrical connection means shall be orientated adjacent the base member and that the inner resilient sections shall be inclined towards the connecting device and that said edge-orientated outer resilient parts shall be inclined towards the metallic casing in one and the same direction from said supportive part.

Solution

With the intention of solving one or more of the aforesaid technical problems, the present invention takes as its starting point a electrical connection means which is included in a cable-related electrical plug-in assembly for one or more coaxial cables, wherein the screening conductor of said one or more coaxial cables shall be connected to ground, and wherein the plug-in assembly has the features defined in the introduction.

A coupling means according to the invention is based on a plurality of spring-like tabs which surround, completely or partially, a second subpart or sleeve of the connecting device, such as to achieve electrical and mechanical coaction between said subpart or sleeve and said tabs, and also on a supportive part which coacts with the tabs and is integral therewith.

The supportive part has obliquely and outwardly facing outer contact surfaces, which are adapted to abut the inner surfaces of opposing parts with an adapted contact pressure when the two parts of the casing part mutually coact, said casing parts being, in turn, ground-potential related.

It is proposed in accordance with the invention that the connecting device will have a specific form in which said inner tabs are corner-related in relation to an otherwise square aperture and orientated in a direction towards a centre line of said aperture, and that narrow supportive parts delimit one aperture from an adjacent aperture.

According to proposed embodiments that lie within the scope of the inventive concept, the assembly includes an insulating base member which includes a plurality of holes or channels, wherein each connecting device inserted into a respective hole coacts with mutually the same ground-related connecting means.

According to one embodiment, the spring-like tabs are formed by elongated resilient, or spring-like, sections that extend from said electrical connection means supportive part.

It is also proposed that the connecting-means supportive part has a generally right-angled outer shape.

According to one embodiment, the supportive part includes tongue-related contact surfaces which are directed obliquely towards one another, and the contact surfaces are formed at the tips or points of four elongated, narrow resilient parts and disposed uniformly around their respective connecting devices.

The aforesaid contact surfaces will preferably be located within a first plane of the elongated resilient parts and each is located outermost on a resilient section.

The resilient sections are disposed in a second plane.

It is also proposed that one subpart of the connecting device will be mounted or received in a respective hole in the base member in a manner which will allow the subpart to tilt or to tip to some extent.

According to one embodiment, the connecting-means supportive part has a square or rectangular shape and is adapted to abut opposing metallic casing parts through the medium of edge-orientated, outer resilient parts.

The resilient parts are advantageously comprised of parallel, related projections.

The electrical connection means may be relatively thin and will normally have a thickness or between 0.07–0.25 mm.

It is also proposed that the electrical connection means are orientated adjacent the base member and that said resilient sections and said edge-orientated resilient parts are arranged to slope slightly in the same direction from said supportive part and towards the base member.

Advantages

Those advantages that are primarily afforded by an electrical connection means that is constructed in accordance with the present invention and included in a cable-related electric plug-in assembly intended to accommodate a plurality of coaxial cables reside in the provision of conditions whereby there is obtained through the medium of a material-lean electrical connection means direct electrical and mechanical contact and direct coaction between the screening conductor or screening stocking of respective coaxial cables and at least one metal casing Dart belonging to the electric plug-in assembly and connecting directly or indirectly to ground, thereby to create conditions for conducting away disturbance voltages and electromagnetic disturbance fields that are liable to seriously jeopardize detection of information-carrying voltage pulses that are transmitted at high transmission speeds on the conductors of the coaxial cables.

A particular advantage resides in the possibilities of creating satisfactory conditions for conducting EMC disturbances to ground potential prior to said disturbances occurring on the system ground.

BRIEF DESCRIPTION OF THE DRAWINGS

An embodiment of a cable-related electric plug-in assembly for accommodating a number of coaxial cables, and two embodiments of electrical connection means used with said assembly in accordance with the invention will now be described in more detail with reference to the accompanying drawings, in which.

DESCRIPTION OF EMBODIMENTS AT PRESENT PREFERRED

Figure 1:
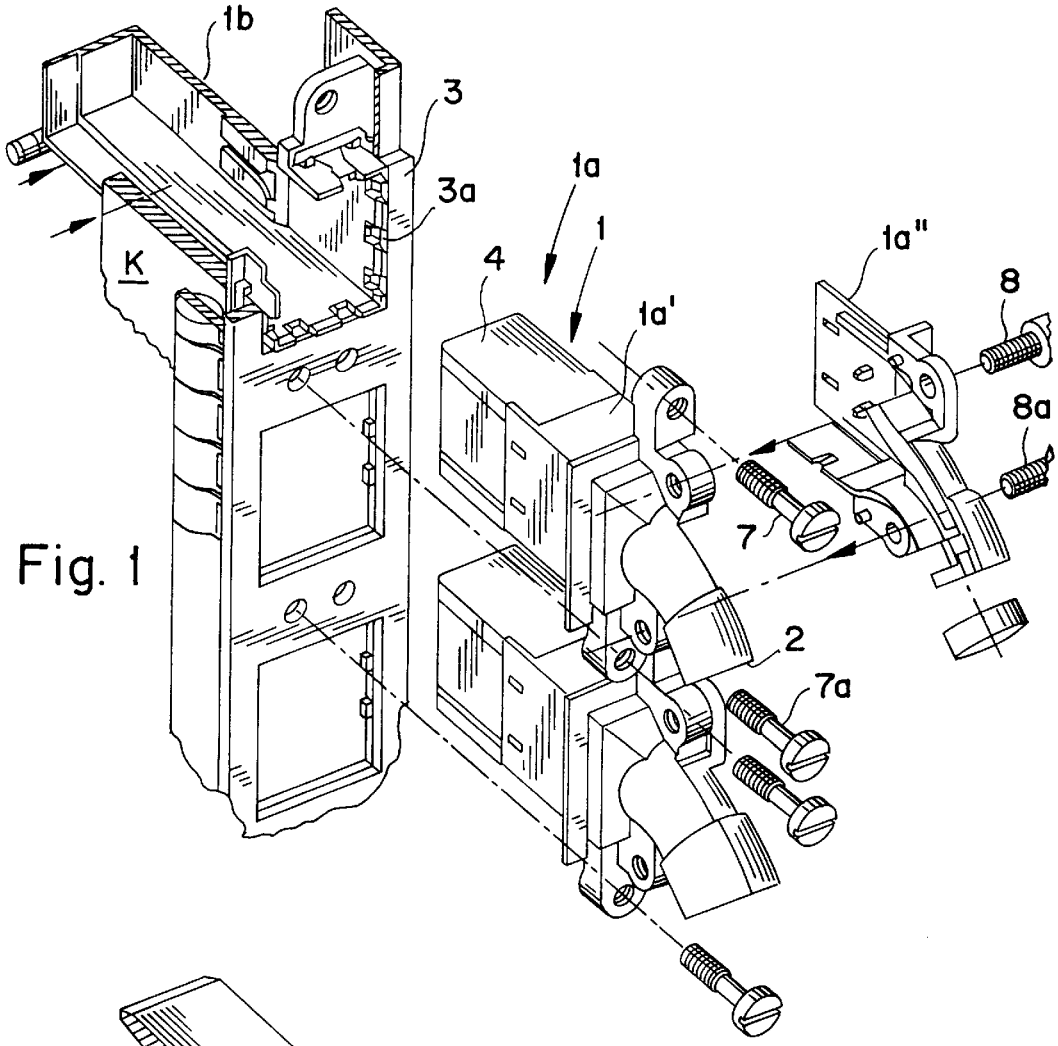
FIG. 1 is a perspective exploded view of an assembled printed circuit board pressed firmly into a board-receiving frame, where an apertured rail or bar is connected to ground potential, and where each plug-in assembly comprises two complementary parts, of which one is shown spaced outside the rail.
Figure 2:
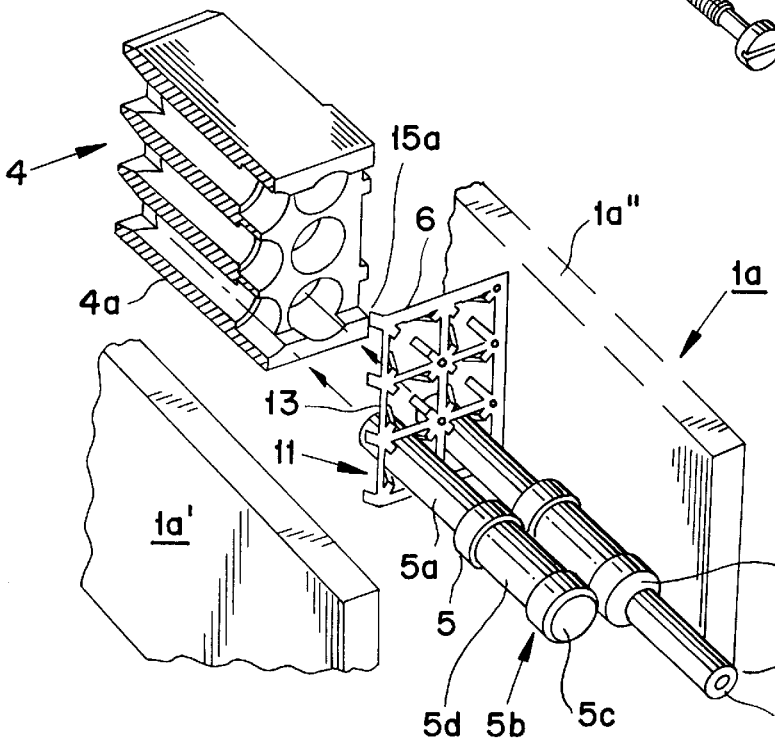
FIG. 2 is an exploded perspective view of a base member which can be inserted into a part of the plug-in assembly shown in FIG. 1 and which includes two times three holes for receiving coaxial-cable type connecting devices and which is provided with electrical connection means according to the invention.
Figure 3:
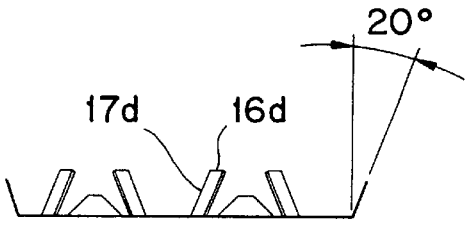
FIG. 3 is a side view of the electrical connection means shown in FIG. 2.
Figure 4:
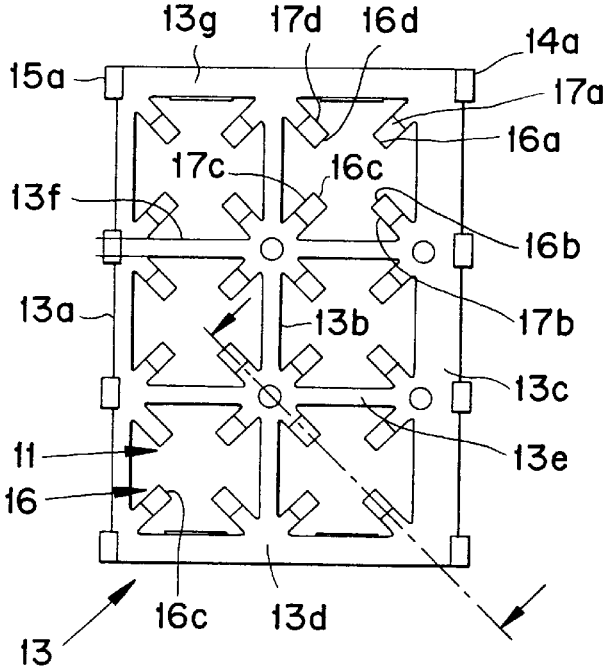
FIG. 4 illustrates the electrical connection means from above.
Figure 5:
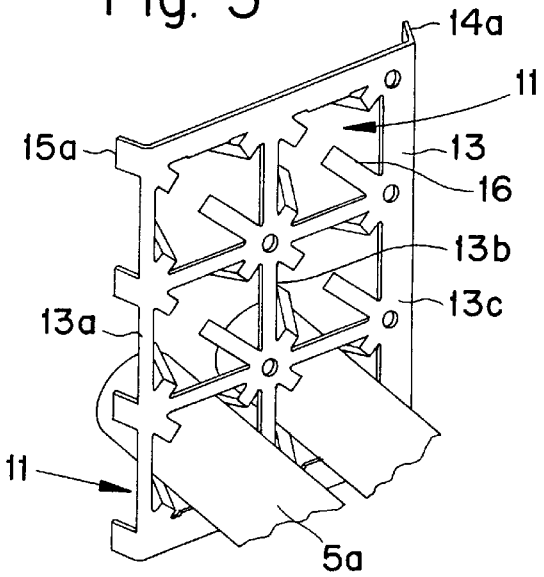
FIG. 5 is an enlarged perspective view of the coupling means shown in FIG. 2.
Figure 6:
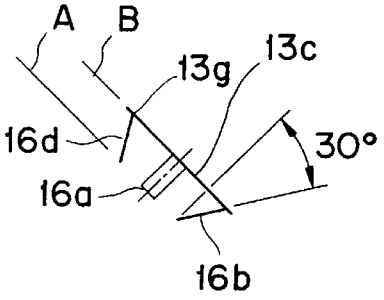
FIG. 6 is a side view of the coupling means, namely the collar-like part that is intended to coact with an electrically conductive, grounded sleeve for the connecting device.

The present invention is thus concerned with an electric plug-in assembly 1 for a coaxial cable 2, and more particularly to a coaxial-cable related connecting part of the assembly 1.

The plug-in assembly 1 is comprised of two complementary parts 1*a*, 1*b*, of which at least one part, 1*b*, can be connected directly to earth potential through the medium of a magazine.

The illustrated electric plug-in assembly 1 includes a coaxial-cable related part 1*a* and a circuit-board related part 1*b*, the part 1*b* being shown fixedly connected to a circuit board K.

In the illustrated embodiment, the part 1*b* is connected to a metallic, ground-potential related rail 3, said part 1*b* being connected to the rail 3 through the medium of an electrically conductive spring arrangement 3*a,* the upper part, or alternatively the lower part, of the rail 3 being connected electrically to ground potential or to an ground reference through the medium of screw connections.

The cable-related part 1*a* of the plug-in assembly includes an outer, two-part metallic casing including the parts 1*a*' and 1*a*" which carry an electrically insulating base member 4.

The base member 4 includes holes or channels (two times three) of which one hole, is referenced 4*a*.

The hole or channel 4*a* is intended to secure a connecting device 5 which extends through a electrical connection means 6 in accordance with the invention.

The two complementary assembly parts 1*a,* 1*b* are so mutually coordinated as to enable said parts to be brought to a mutually coacting position (not shown in FIG. 1) for electrical and mechanical coaction between a coaxial-cable related connecting device 5 placed between said parts, or to be brought to a non-coacting position in which there is no electrical and mechanical coaction between the coaxial-cable related connecting device positioned between said parts.

For the sake of clarity, the connecting devices intended for the part 1*b* have not been shown in the Figure.

The casing of at least one of said assembly parts, namely the part 1*a,* embraces an electrically insulating base member 4 which is intended to accommodate a plurality of connecting devices.

Each of said channels or holes, such as the hole 4*a,* is adapted for coaction with a first subpart 5*a* of a sleeve-like connecting device 5, and with a second subpart 5*b* adapted for coaction with a coaxial cable 2 whose screening conductor 2*a* is intended to be capable to embracing the second subpart 5*b*.

When a stripped coaxial cable 2 is inserted into a hole 5*c,* with the central conductor 2*b* adapted to coact with the first subpart 5*a,* the screening conductor 2*a* can be threaded over a sleeve inserted into the subpart 5*b* and the part 5*d* secured over the subpart 5*b* with the screening conductor 2*a* held therebetween, e.g. with the aid of a crimping tool.

The base member 4 will thus be accommodated within the part 1*a*' and the part 1*a* is held to the part 1*b* in an assembled state with the aid of screws 7, 7*a*.

The part 1*a*" can be secured to the part 1*a*' with the aid of screws 8 and 8*a,* in a known manner.

The inventive electrical connection means 6 includes a spring-related tab-like collar 11 which extends completely around the second subpart 5*b* of the connecting device, to obtain electrical and mechanical coaction between said subpart 5*b* and said collar 11.

The electrical connection means 6 also includes a supportive part 13 which coacts with the collar 11 and which may be integral therewith.

The supportive part 13 is rectangular in shape and includes along one long edge four outer resilient or springy contact surfaces, of which one is referenced 14*a,* and along the other edge four resilient or springy contact surfaces which are parallel with the aforesaid contact surfaces and of which one is referenced 15*a*. The contact surfaces are adapted to abut inner, opposing metal surfaces on the metal part 1*a*' or the metal part 1*a*" with an adapted contact pressure.

As before mentioned, the base member 4 may include a plurality of holes, in the illustrated embodiment 6 holes, and that each connecting device inserted into a respective hole is able to coact with the electrical connection means, shown in FIGS. 3–6.

The resilient or springy tab-like collar 11 is formed by resilient or springy sections 16 that extend from the part 13 supporting said electrical connection means 6.

The supportive part 13 has a right-angled external shape and includes three mutually parallel side members 13*a,* 13*b* and 13*c,* and four mutually parallel side members 13*d,* 13*e,* 13*f* and 13*g* which extend perpendicularly to the first-mentioned side members. The side members thus define in the supportive part 13 six square apertures of which each presents four outer collar-related contact surfaces 16*a,* 16*b,* 16*c,* 16*d* which are inclined obliquely in relation to one another and which are formed at the tips of four elongated resilient parts 17*a,* 17*b,* 17*c* and 17*d* whose bases coact with the corners of said members 13*b,* 13*c,* 13*f,* 13*g*.

The contact surfaces 16*a,* 16*b,* 16*c* and 16*d* are located within a first plane "A" which extends adjacent resilient or springy sections on which said elongated, resilient or springy contact surfaces 16*a,* 16*b,* 16*c* and 16*d* are provided.

The resilient sections are disposed in a second plane "B" which extends slightly sideways of the first plane but parallel therewith.

It is important to the present invention that one subpart 5*a* of the connecting device can be secured in the hole 4*a* in the base member 4 in a manner which will enable said subpart to be tilted or tipped in order to compensate for a poor fit. To this end, the resilient sections 16*a*–16*d* are orientated so that the sleeve 5*a* with an applied tab-like collar 11 is able to move without resulting in any appreciable movement of the supportive part 13.

The connection means 6 may have a material thickness of between 0.07–0.25 mm, preferably about 0.15 mm, and may be made of stainless steel.

When the parts 1*a*' and 1*a*" coact within a part 1*a,* the contact surfaces 14*a,* 15*a,* which extend obliquely towards one another, will lie against the inner opposing surfaces of one or both casing parts with a given contact pressure.

Figure 7:
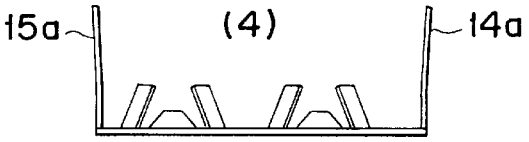
FIG. 7 is a side view of a second embodiment of a electrical connection means.
Figure 8:
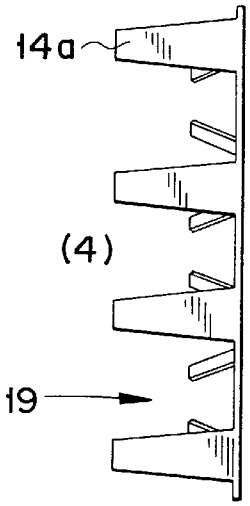
FIG. 8 is another side view of the electrical connection means shown in FIG. 7.
Figure 9:
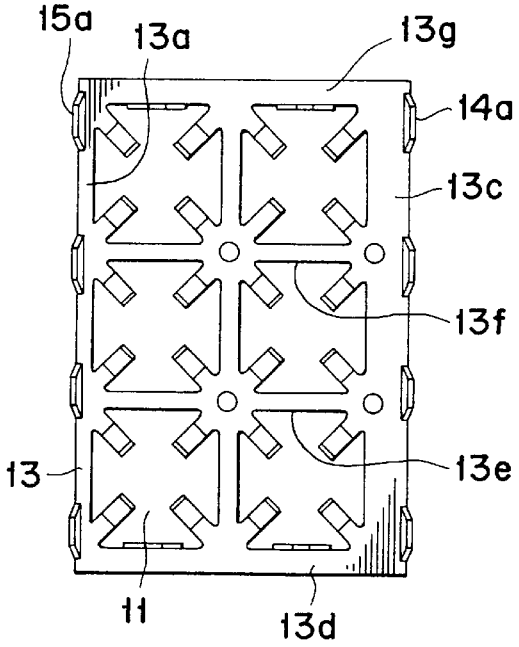
FIG. 9 shows the electrical connection means of FIG. 7 from above.

FIGS. 7–9 illustrate a second embodiment in which the contact surfaces 15*a,* 14*a* have longer lengths.

Figure 10:
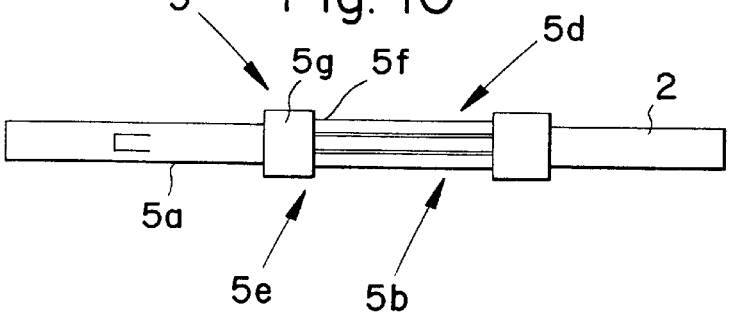
FIG. 10 is a side view of a connecting device coupled to a coaxial cable.

The part 6 of both embodiments shall be made of stainless steel and gilded so that the contact surfaces 16*a,* 16*b,* 16*c* and 16*d* will be comprised of gold and capable of abutting a gilded contact point 5*f* adjacent a collar 5*g,* as shown in FIG. 10.

The contact surfaces 14*a,* 15*a* are tin-coated, as they are intended to abut tin-coated casing parts.

FIG. 10 illustrates a connecting device 5 whose subpart 5*a* is inserted through a supportive part 13 to an extent at which the collar 5*g* has passed the contact surfaces 16*a*–16*d,* which therewith snap-in behind the collar 5*g,* so that said contact surfaces will lie against the sleeve 5 with the requisite contact pressure.

In order to achieve the aforesaid tippable or tiltable attachment, the fulcrum or pivot point will preferably lie around the collar 5*g,* and more preferably at the point referenced 5*f*.

It will be understood that the invention is not restricted to the aforedescribed and illustrated exemplifying embodiments thereof and that modifications can be made within the scope of the inventive concept as defined in the following claims.

We claim:

1. An electric coaxial cable plug-in assembly having electrical connection means which can be connected to earth potential, comprising:

two or more connecting devices, each of the two or more connecting devices being adapted to receive a coaxial cable;

first and second complementary parts, the first and second complementary parts forming a structure in which the two or more connecting devices are received, the first part being connectable to ground potential and the second part being divided into a plurality of parts, the first and second parts being movable between a position for electrical and mechanical coaction between the two or more connecting devices and the first part and a position in which no electrical and mechanical coaction exists between the first part and the two or more connecting devices, the second part embracing an electrically insulating base member that receives the two or more connecting devices, the base member including two or more through-penetrating holes, each hole coacting with a first subpart of a respective one of the two or more connecting devices and coacting with a second subpart of the respective one of the two or more connecting devices, the second subpart being adapted for coaction with a coaxial cable having a screening conductor for embracing the second subpart; and electrical connection means including a supportive part in which two or more square-shaped apertures are formed, each of the two or more apertures being delimited from an adjacent aperture of the two or more apertures by rectangular side members of the supportive part, and each of the two or more apertures extending at least partially around a second subpart of a corresponding one of the two or more connecting devices, the electrical connection means further including four inner tabs corresponding to each of the two or more apertures, each inner tab extending from a corner of a corresponding one of the two or more apertures toward a center of the corresponding one of the two or more apertures, the supportive part including one or more outer contact surfaces for abutting under pressure against the second part;

wherein each first subpart of each connecting device of the two or more connecting devices is secured in a corresponding hole of the two or more holes of the base member such that the first subpart is tiltable relative to the base member to compensate for a poor fit in the base member.

2. A plug-in assembly according to claim 1, wherein each inner tab includes a resilient section that is oriented so that the first subpart is movable through the corresponding aperture of the two or more apertures relative to the supportive part.

3. A plug-in assembly according to claim 1, wherein each inner tab includes an elongated resilient section.

4. A plug-in assembly according to claim 2, wherein, for each inner tab, a contact surface for contacting the first subpart of the corresponding contact device is provided at a tip of the resilient section of the inner tab.

5. A plug-in assembly according to claim 4, wherein the contact surfaces of the inner tabs are disposed within a first plane parallel to a plane of the side members of the supportive part.

6. A plug-in assembly according to claim 5, wherein the side members of the supportive part are disposed in a second plane different from the first plane.

7. A plug-in assembly according to claim 1, wherein the supportive part is between 0.07–0.25 mm thick.

* * * * *